US005950396A

United States Patent [19]

Fosdick, Jr.

[11] Patent Number: 5,950,396

[45] Date of Patent: Sep. 14, 1999

[54] METHOD AND APPARATUS FOR PRODUCING AND ERECTING PRECAST CONCRETE WALLS USING SAWING

[76] Inventor: Frank D. Fosdick, Jr., P.O. Box 1924, Pueblo, Colo. 81002

[21] Appl. No.: 08/821,190

[22] Filed: Mar. 19, 1997

[51] Int. Cl.[6] ..... E04B 2/04; E04C 2/06; E04C 2/288

[52] U.S. Cl. ..... 52/742.14; 52/125.4; 52/309.12; 52/405.1; 52/745.19; 29/897.32

[58] Field of Search ..... 52/125.4, 309.12, 52/309.17, 405.1, 742.14, 745.19, 745.2; 29/897.32

[56] References Cited

U.S. PATENT DOCUMENTS

| | | | |
|---|---|---|---|
| 3,679,529 | 7/1972 | Prusinski et al. | 52/309.12 X |
| 4,290,246 | 9/1981 | Hilsey | 52/742.14 X |
| 4,450,128 | 5/1984 | Takeuchi | 52/309.17 X |
| 4,841,702 | 6/1989 | Huettemann | 520/309.12 |
| 5,381,635 | 1/1995 | Sanger | 52/309.12 X |
| 5,588,272 | 12/1996 | Haponski | 52/309.12 |
| 5,597,627 | 1/1997 | Lindeberg | 52/742.14 X |

*Primary Examiner*—Christopher T. Kent

[57] ABSTRACT

A system and apparatus has been developed for factory built panelized, precast insulated concrete walls. The interior as well as the perimeter walls of the home are solid reinforced concrete. The concrete walls make a home fireproof, low maintenance, air tight, with thermal mass for heat storage insulated on the outside which makes it more energy efficient. Concrete for the exterior walls is poured over a rigid insulation board so that when the walls are erected they are insulated on the outside. This protects the concrete from the elements and makes the concrete available to the interior of the building for thermal mass to store heat. The walls are poured in one continuous row and cut into individual panels after hardening. Lifting bolts, anchor bolts, weld plates, electrical outlets, window and door placement are all indicated on the top plate at the manufacturing plant. The manufactured reinforcing panels are laid on casting slabs for concrete to be poured and finished. The casting slab is created to have the ability to pour walls of various heights. The option of transitional walls being exterior on one end and interior on the other end of the same panel is made possible in this invention. After the walls are cut they are lifted with special anchor bolts by a spreader bar hoisted by a crane and loaded onto trailers. They are then transported to the construction site and erected on a foundation. When the walls are erected the exterior walls are already insulated and ready for stucco or siding on the outside. Electrical boxes with conduit to the top of the wall are imbedded. The interior walls are ready to be textured and painted.

11 Claims, 4 Drawing Sheets

METHOD AND APPARATUS FOR PRODUCING AND ERECTING PRECAST CONCRETE WALLS USING SAWING

BACKGROUND OF THE INVENTION

This invention relates to the production of insulated precast concrete walls for residential buildings. Commercial buildings are often built by tilt-up or precast concrete walls that are either not insulated or are insulated on the inside of the concrete after erection of the walls. Residential houses are conventionally built using wood frames with insulation between the wood studs and sheetrock covering the wood. Both of these methods make for an inefficient building in terms of the energy required to keep the building at a comfortable temperature. The increasing price and decreasing quality and availability of lumber has led to an interest in alternative building systems.

Insulating concrete walls on the outside protects them from climatic changes and provides thermal mass to the interior to store heat, thus making the home more energy efficient. This invention is different from other insulated concrete walls that are "sandwich" panels or light weight concrete with insulation imbedded therein. This invention has insulation on the exterior face of the wall with concrete on the interior surface of the wall. Homes built by this invention have been monitored and documented by the U.S. Department of Energy, National Renewable Energy Laboratory (NREL) in Golden Colo. They were found to perform 85% better than ASHRAE standards.

This is the only method of home building where not only the exterior walls are concrete, but the interior partition walls between the rooms are also precast concrete. Producing the insulated exterior and uninsulated interior wall panels on two casting beds and then cutting the poured wall into individual wall panels saves on material and labor over when individual walls are formed and poured.

BRIEF SUMMARY OF THE INVENTION

This invention includes a method of mass producing concrete walls for homes made of concrete. It is realized homes have been built of concrete wall panels in the past. It is also realized that individual concrete panels have been cast of concrete laying flat or horizontally, and then "tilted-up" in the past, as is the common practice in commercial concrete "tilt-up" building.

The present invention differs from past procedures in that walls are usually panelized individually by forming all four sides of each panel. In this method panels are all cast laying flat or horizontally in one long row as one panel and fully connected to one another in a single integral concrete pouring and finishing stage. The insulated exterior walls are poured on one casting bed and the uninsulated interior partition walls are poured on another. Then the rows of integrally connected concrete walls are separated by cutting or sawing across the long row of hardened concrete at the proper locations in order to define individual portable tilt-up wall panels.

Other precast panels have been developed by other inventors for buildings, usually commercial applications. The purpose is to build a residential building of superior thermal resistance with insulation on the outside and concrete on the interior surface. Other systems do not have partition walls between the rooms made of concrete, they also do not allow for electrical boxes and conduit within the concrete.

In this method 4" thick structural concrete walls of houses, are cut. Concrete panels sit on a foundation.

Initially in this invention, perimeter forms are assembled on the casting slab, into which the concrete is poured. The forms can be wood or metal, and are disassembled and reused. The top of the wall form may be permanently left in place as a structural component (top plate) of the finished building. The perimeter forms can be structured for producing walls of various heights, although eight feet will be most common for homes. The thickness of the walls equals the height of the forms which will normally be 4 inches, but this wall thickness will be greater with a higher wall. The length of the perimeter forms can extend to any desired length for the linear feet of walls needed. Reinforcing steel rebar grids sized for a given length of wall section are placed within the perimeter forms a short distance apart leaving a space in the area where concrete sawing will occur. Window and door openings are sectioned off in the steel rebar grids and blocked with wooden boxes of the same height as the perimeter forms so as to exclude concrete from these areas. The wood blockouts stay in place in the concrete wall to later act as nailers for the window and doorjambs. When the concrete is poured, all the wall sections are finished as a single unit with the top edges of the perimeter forms used to level the concrete.

The walls are poured in one single integral concrete pour, then finished by hand or machine trowel. They are allowed to harden, and then the single integral concrete panel is cut or sawn into the individual walls. The wall sections are then tilted up and lifted onto trailers for hauling to the jobsite. They are secured in place on the foundation with weld plates. The individual walls may also be cast on the job site and tilted up into place. It is the object of this invention to provide a flat concrete wall insulated on the exterior and smooth on the interior which can be erected and then simply textured and painted for residential use.

DETAILED DESCRIPTION OF THE INVENTION

Figure 1:
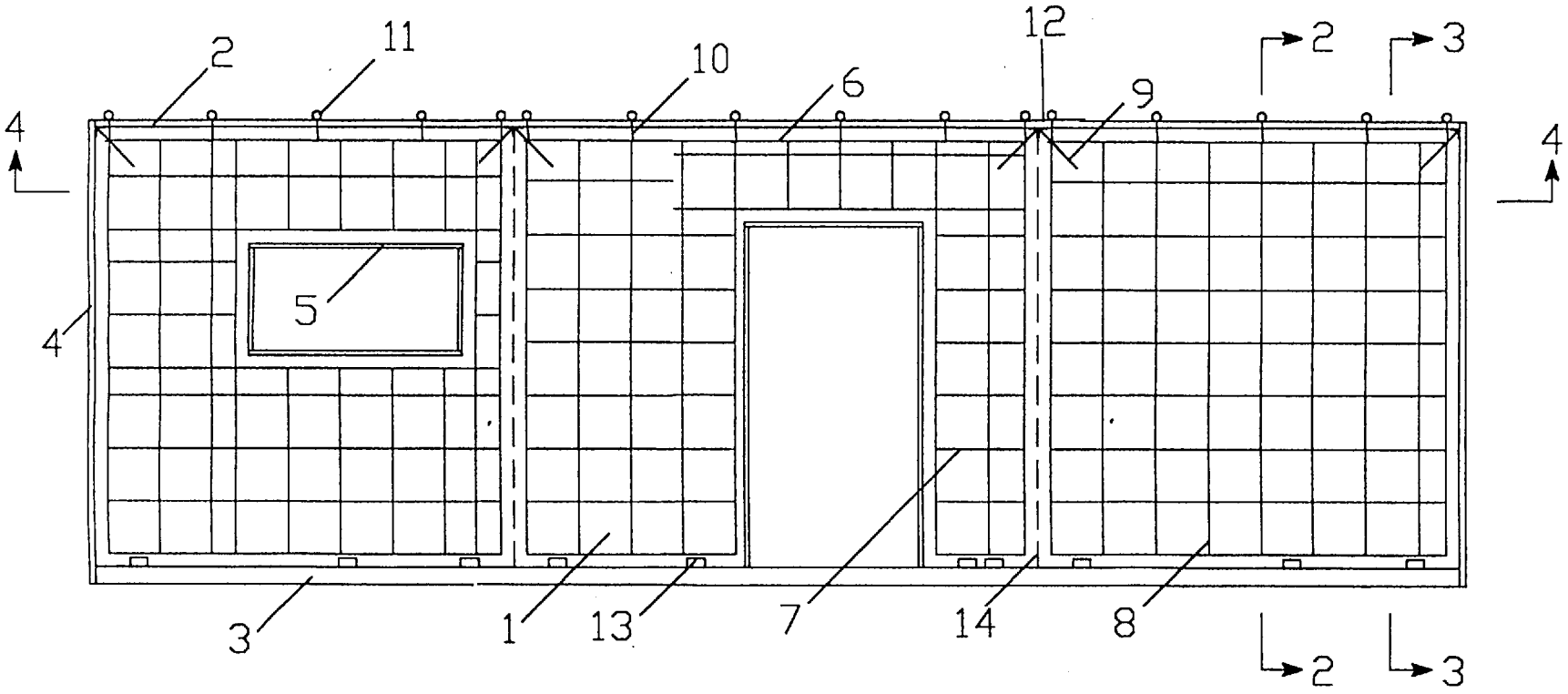
FIG. 1 is a top plan view of the perimeter forms with four steel rebar grids, one grid per wall panel shown positioned therein prior to pouring the concrete. Windows and door blackouts are also shown.

Construction begins with factory built forms and a rebar reinforcement panel containing a complex layout of parts as shown in FIG. 1. The wood or metal top plate 2, bottom plate 3 and side forms 4 are set for the perimeter of the wall slab 1. The height of the forms 2–4, which corresponds to the thickness of the walls can be changed as well as the height and length of the wall slab 1 itself. Blockouts 5 that are secured to the reinforcing panel, act as concrete forms to designate space for future doors and windows, remaining in place to be used for the installation of these elements later. A perimeter reinforcing bar 6 is then positioned within the forms 2–4 to designate areas for specific walls within the full wall slab 1. Horizontal 7 and vertical 8 steel reinforcement is then added at 12 inches on center (or per engineering) to increase the strength of the wall slab 1. Additional reinforcing is added around doors and windows to integrate the structural support needed in these areas, thus taking the place of lintels in a stick-built house. Diagonal reinforcement 9 is included in what will be the top comers of the individual walls slabs attached to the top weld plates 12. The anchor bolts 10 are placed through the top plate 2 starting 3 inches from the edge of the wall and continuing at 24 inches on center. These bolts 10 are manufactured with hooks for the precise location of the perimeter reinforcing 6 and are thus structurally connected to the wall. Lifting eyes 11, which are screwed to the anchor bolts 10, are used to lift and place the walls later and will be removed and reused. The top weld plates 12 are welded to diagonal reinforcing 9 and are placed at what will be the upper comers of the walls as well as areas where walls meet mid-panel. The foundation weld plates 13 are located 8 inches from the ends of what will be the bottom comers of the walls, continuing at 48 inches on center. After placement of all interior elements (5–9, 12–13), the concrete is then poured for the group of walls, later to be cut along predetermined cutting lines 14.

Figure 2:
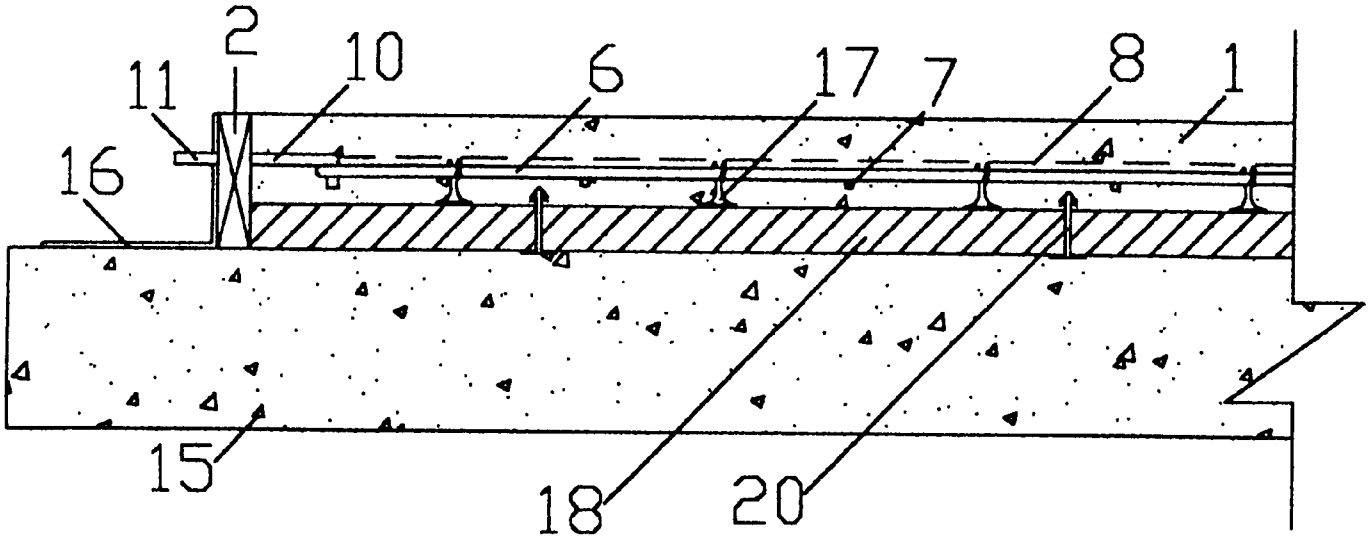
FIG. 2 is a cross sectional side view of an exterior wall panel showing the insulation on the casting bed.
Figure 3:
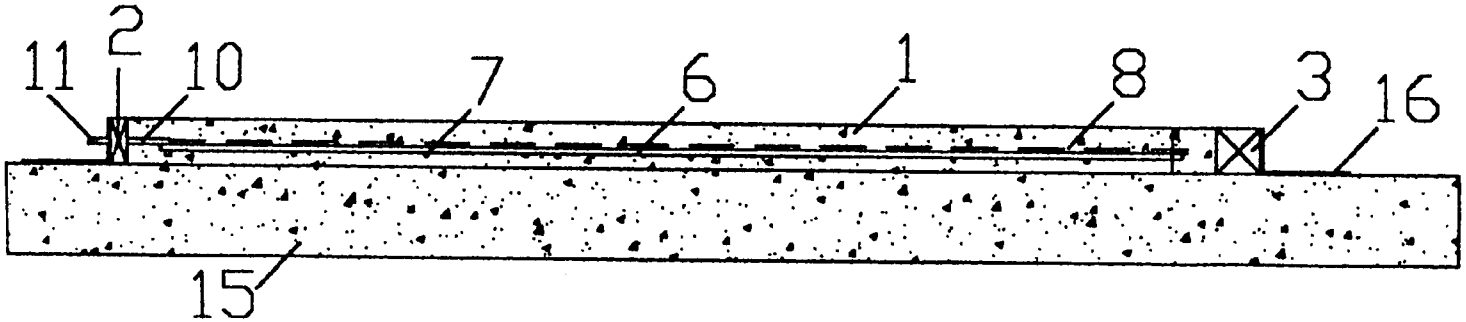
FIG. 3 shows a cross sectional side view of an interior wall panel.
Figure 4:
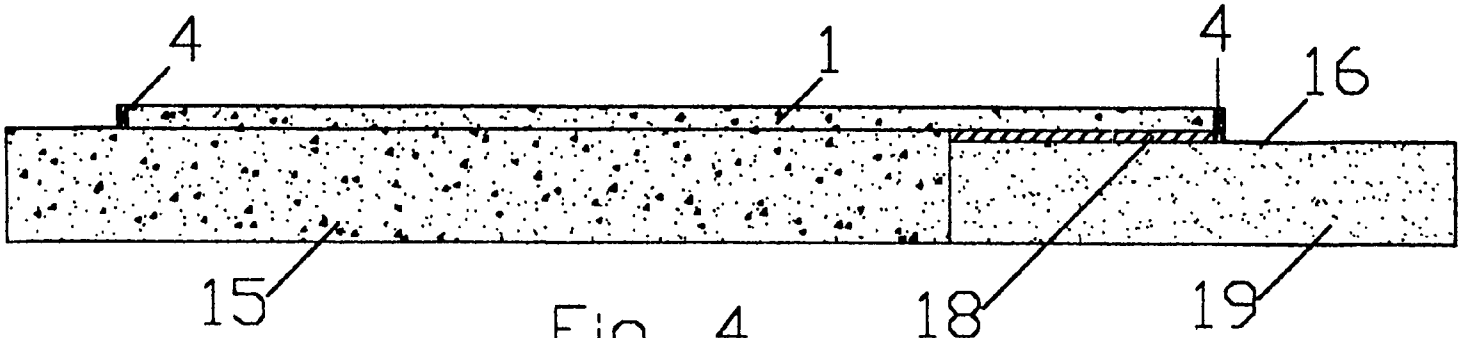
FIG. 4 is a cross sectional top view showing a transitional wall which is part interior and part exterior wall.

As seen in FIGS. 2–4, this process is all done on top of a casting slab 15, which can be located either on the future site of the home or at a factory location. Theoretically, the casting slab 15 could extend to any length to allow for the pouring of different sizes of homes, or, more importantly, several homes at the same time. Prior to pouring exterior walls, rigid insulation boards 18 (preferably polyisocyanurate) are placed on the casting slab 15 prior to the item to be embedded, and the height of the blocking 2–5 is adjusted accordingly. Barbed connectors 20 are attached every 16 inches on center through the exterior of the insulation sheeting 18 prior to layout. These connectors 20 are then encompassed by the concrete during the pouring of the slab 1, thus attaching the insulation sheeting 18 to the slab 1.

Adjustable hardware 16 is located on the casting slab 15 to hold the blocking 2–4 in the correct positions and can be placed to accommodate eight to ten foot ceilings for use in special conditions. Concrete chairs 17 are used to elevate the reinforcing bars 6–8 to locate the bars in the center of the 4 inches slab.

Unique to this system is the development for the ends of the casting beds. A sand bed 19 is utilized as shown I FIG. 4 to allow for the pouring of a wall panel in with both interior and exterior areas. This omits the need for pouring two separate walls at these locations. The sand beds 19 can also be used for countersinking bolts, hardware, or metal screw strips (protruding through the insulation and imbedded in concrete on the inside) to attach wood or metal exterior siding or trim. The beds 18 would also allow for staking special blockouts or hardware for attaching shutters, beams, etc. as needed. The sand beds 19 also allow for the creation of walls taller than the casting slab normal limit of ten feet. This application is used only in site-located pouring, as the resultant tall walls are not able to be transported via trailer.

Figure 5:
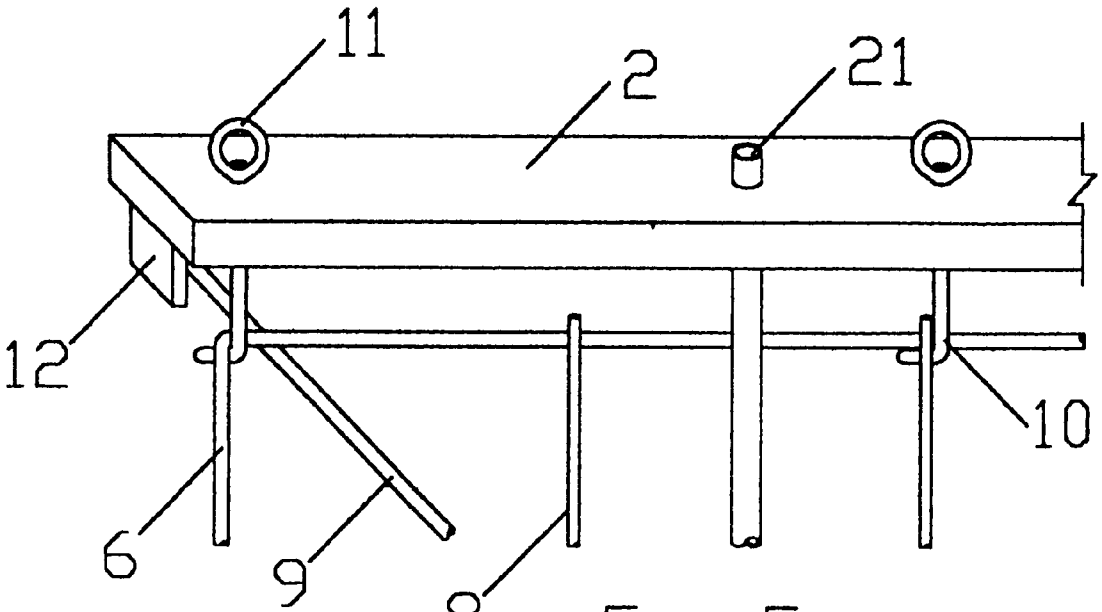
FIG. 5 hows a detailed axonometric view of the top plate with imbedded items.

The detail of the top plate 2 in FIG. 5 shows the intricate alignment of anchor bolts 10 and lifting eyes 11, perimeter 6 and vertical 8 reinforcing, diagonal reinforcing 9 and weld plates 12, as well as conduit 21 for future wiring such as electrical, telephone, cable television or security. The top plate 2 is produced in the manufacturing plant with the help of computer-aided design which accomplishes precise and exact layouts and locations of all necessary imbedded items. Holes are drilled prior to the setting of the top plate 2 for anchor bolts 10 and conduit 21. The top plate 2 will remain with the wall slabs permanently, being used for the attachment of roof trusses when the building is erected.

The concrete is then poured between the forms 2–5. The concrete used is standard five sacks of cement per yard of concrete, ¾ inch aggregate and a strength of 3000 psi, or per engineering specifications. The forming techniques and hardware used are designed to be flush with the surface of the concrete so as not to impede in the finishing of the concrete by vibrating air screeds and finishing tools traveling on the forms.

Figure 6:
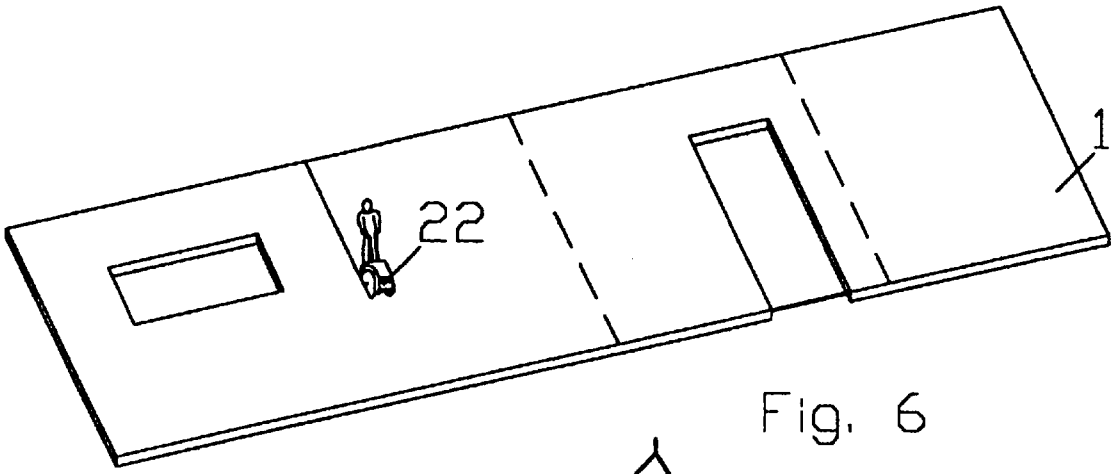
FIG. 6 is a top isometric view of the finished concrete slab in the process of being cut into individual wall sections.

After the concrete has been poured and a 24 hour setting period, the slab 1 is then cut to the predetermined wall lengths using a typical rotary powered concrete saw 22 as shown in FIG. 6. The perimeter reinforcing 6 is left in place at the door opening location. The wall system is engineered such that this will be covered by the poured-on-site concrete floor slab later.

Figure 7:
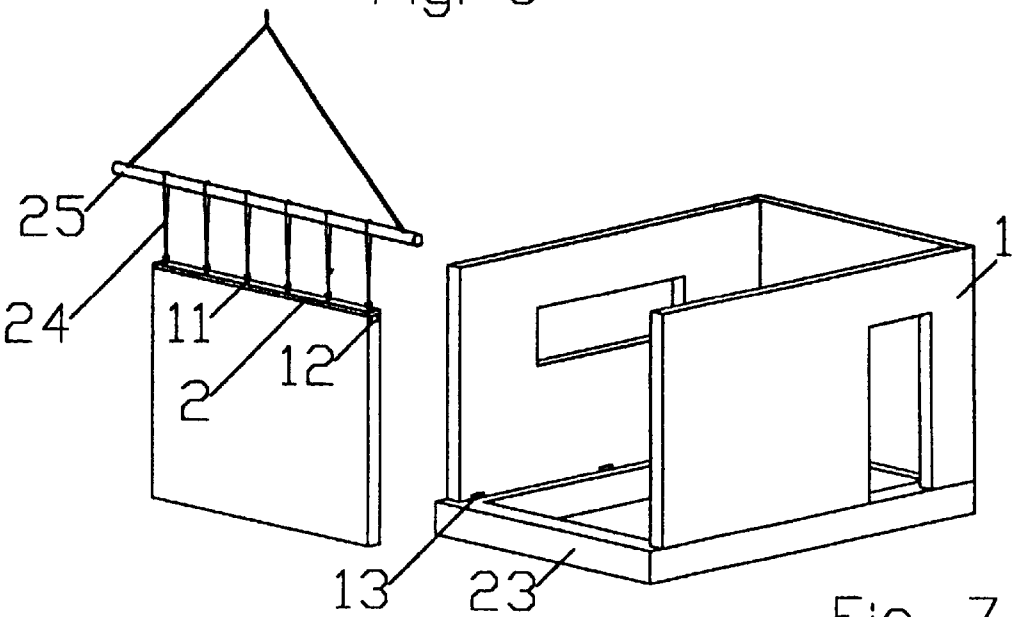
FIG. 7 illustrates the individual wall sections being assembled into a house.

After proper curing, the wall panels 1 are lifted by crane or other heavy duty equipment by a lifting bar 25 equipped with lifting straps 24 which are hooked in the lifting eyes 11. The wall panels are loaded onto a trailer to be hauled to the construction site. The equipment is then used to lift the walls 1 from the trailer to the pre-poured, insulated foundation 23 on site as shown in FIG. 7. The foundation weld plates 13 on the walls 1 are then matched up to weld plates embedded in the foundation and welded for permanent attachment. The top weld plates 12 from adjoining walls are then welded to form the permanent attachment of the walls to each other. The wall panels 2 are then grouted at the corners per conventional concrete construction technique. The floor slab is then poured within the walls, above the foundation, covering the perimeter reinforcing at the doors as well as the foundation weld plates 13. Standard walls are 8 feet, 4 inches allowing 4 inches for the floor slab, and a finished ceiling height of 8 feet.

After the walls are erected, the roof trusses are then attached per design specifications. The top plate 2 is used to nail the trusses and for attaching gypsum board for the ceiling. Cove molding or gypsum board is then nailed to the top plate 2 to finish the intersection of the wall to the ceiling. Windows and doors are installed with jambs nailed to the wood blockouts in the walls. Stucco or siding is applied for the exterior finish of the home.

I claim:

1. A method for fabricating a plurality of insulated concrete wall panels for use in constructing a building, the method comprising:

(a) providing and assembling a perimeter form on a concrete casting bed to form a perimeter of an elongated slab wherein a top form of said perimeter form comprises a top plate for said wall panels;

(b) positioning an insulation sheet on said casting bed within said perimeter form;

(c) locating spaced connectors on said insulation sheet for fastening said insulation sheet to a cementitious material to be poured;

(d) pouring a cementitious material onto said insulation sheet within said perimeter form to form said elongated slab;

(e) allowing said cementitious material to at least partially cure; and (f) cutting said elongated slab into said plurality of insulated concrete wall panels.

2. The method of claim 1 further including placing rebar chairs on the insulation sheet and placing rebar reinforcement panels on the rebar chairs prior to the step of pouring said cementitious material.

3. The method of claim 1 further including placing at least one of stay-in-place window and door blockouts within the form prior to the step of pouring said cementitious material for defining at least one of window and door openings in said wall panels and wherein said blockouts provide connection frames for attaching said windows and doors in the window and door openings.

4. The method of claim 1 further comprising attaching lifting eyes to the top plate prior to the step of pouring said cementitious material for enabling movement and erection of the wall panels.

5. The method of claim 1 further comprising attaching anchor bolts to the top plate prior to the step of pouring said cementitious material wherein said anchor bolts include ends having hooks locating rebar reinforcement panels.

6. The method of claim 1 further comprising attaching diagonally extending reinforcement members to weld plates which are attached to the top plate prior to the step of pouring said cementitious material.

7. The method of claim 1 further comprising attaching weld plates to the top plate prior to the step of pouring said cementitious material.

8. The method of claim 1 further comprising placing foundation weld plates in the form prior to the step of pouring said cementitious material, wherein said foundation weld plates are spaced from, and adjacent, an edge of the form opposite the top plate.

9. The method of claim 1 further comprising placing conduit for utilities in the form for allowing installation of wiring in the wall panels prior to the step of pouring said cementitious material.

10. The method of claim 1 wherein the step of locating spaced connectors on said insulation sheet further comprises placing barbed connectors through said insulation sheet for securing the insulation sheet to the cementitious material upon curing.

11. The method of claim 1 further comprising forming a section of said elongated slab for use as a combination interior and exterior wall panel wherein said insulation sheet does not extend to a full length of the perimeter form resulting in a section of slab without said insulation sheet.

* * * * *